US006554353B1

(12) United States Patent
Yu

(10) Patent No.: US 6,554,353 B1
(45) Date of Patent: Apr. 29, 2003

(54) DUAL-PURPOSE CHAIR

(76) Inventor: Cheng-Yi Yu, P.O. Box 453, Taichung (TW)

( * ) Notice: Subject to any disclaimer, the term of this patent is extended or adjusted under 35 U.S.C. 154(b) by 0 days.

(21) Appl. No.: 10/006,153

(22) Filed: Dec. 10, 2001

(51) Int. Cl.[7] ..... A47C 13/00
(52) U.S. Cl. ..... 297/130; 297/58
(58) Field of Search ..... 297/55, 58, 130, 297/134, 378.1, 344.12, 452.63, 440.1, 440.22

(56) References Cited

U.S. PATENT DOCUMENTS 2,270,562 A * 1/1942 Schermerhorn
2,731,072 A * 1/1956 Post
2,740,464 A * 4/1956 Hamilton
5,498,054 A * 3/1996 Tomlinson
5,806,922 A * 9/1998 Mendelovich
6,074,013 A * 6/2000 Hsiao
6,345,864 B1 * 2/2002 Rivera et al.
6,386,627 B1 * 5/2002 Tsai

* cited by examiner

*Primary Examiner*—Milton Nelson, Jr.
(74) *Attorney, Agent, or Firm*—Harrison & Egbert

(57) ABSTRACT

A dual-purpose chair comprises a seat structure and a base structure fastened detachably with the seat structure. When the seat structure and the base structure are fastened together, the chair serves as an office chair. The seat structure can be separated from the base structure for use as a deck chair.

3 Claims, 6 Drawing Sheets

DUAL-PURPOSE CHAIR

BACKGROUND OF THE INVENTION

1. Field of the Invention

The present invention relates generally to a chair, and more particularly to a dual-purpose chair which can be interchangeably used as an office chair and a deck chair.

2. Description of Related Art

The conventional chairs, such as office chair, leisure chair, deck chair, massage chair, etc., are designed for one purpose. As a result, the convention chairs can not be used interchangeably for purposes other then the one for which they are intended. In order to enhance the marketability of a chair, it is necessary to broaden the versatility of the chair.

BRIEF SUMMARY OF THE INVENTION

The primary objective of the present invention is to provide a dual-purpose chair which can be used as an office chair or deck chair.

In keeping with the principle of the present invention, the foregoing objective of the present invention is attained by a dual-purpose chair comprising a seat structure and a base structure. The seat structure can be independently used as a deck chair. In the meantime. The seat structure can be used as an office chair in conjunction with the base structure.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
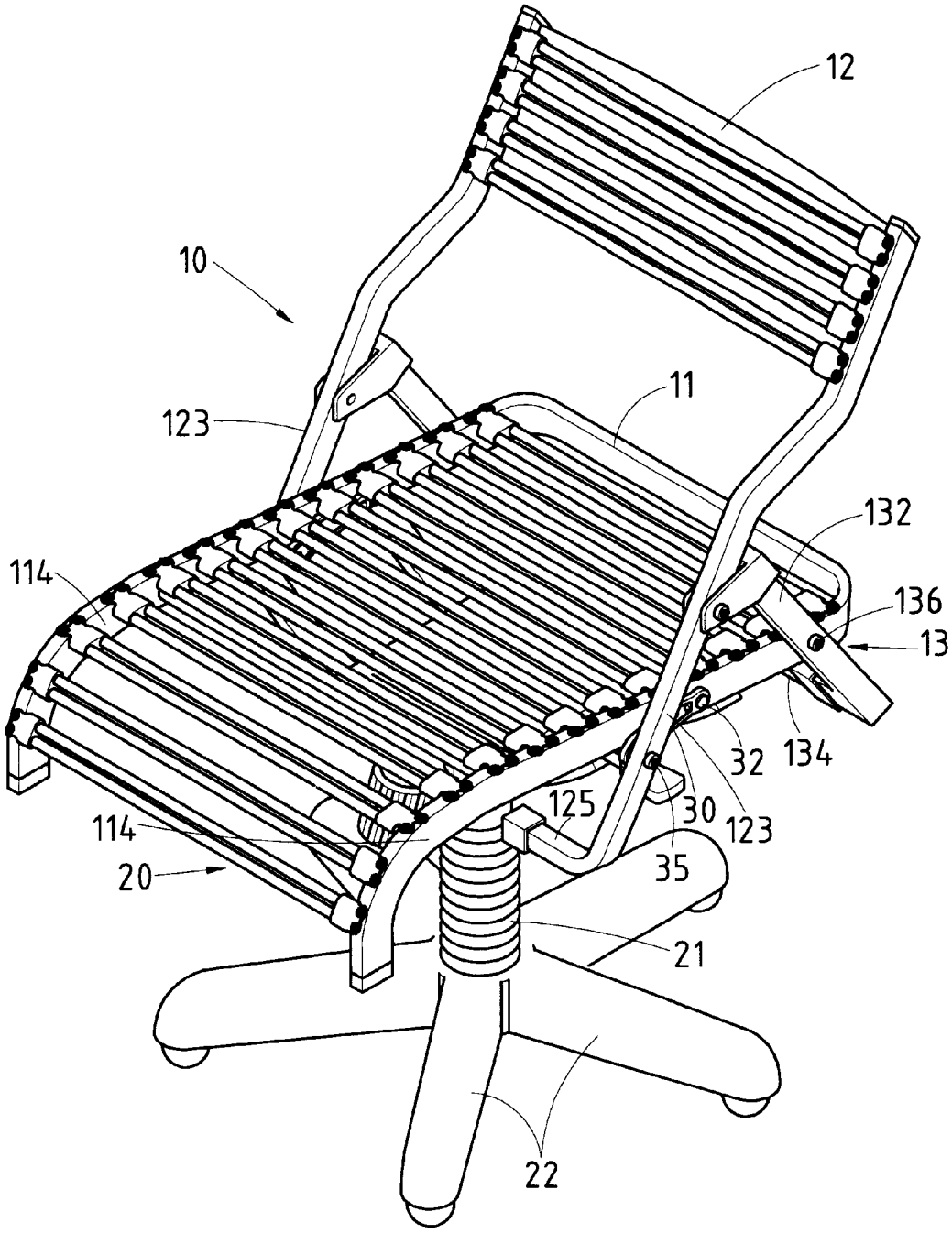
FIG. 1 shows a perspective view of the preferred embodiment of the present invention being used as an office chair.
Figure 2:
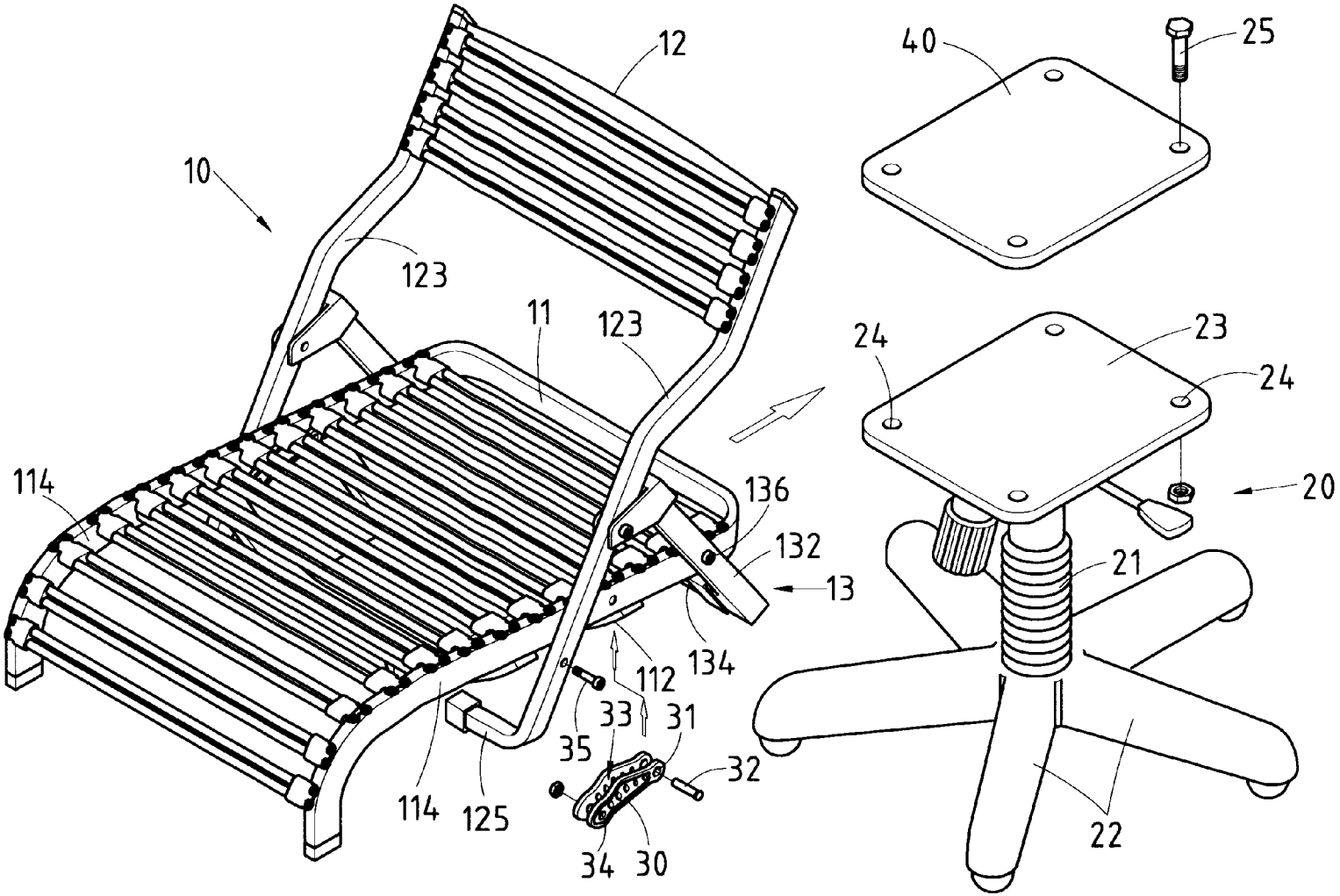
FIG. 2 shows an exploded view of the preferred embodiment of the present invention as shown in FIG. 1.
Figure 3:
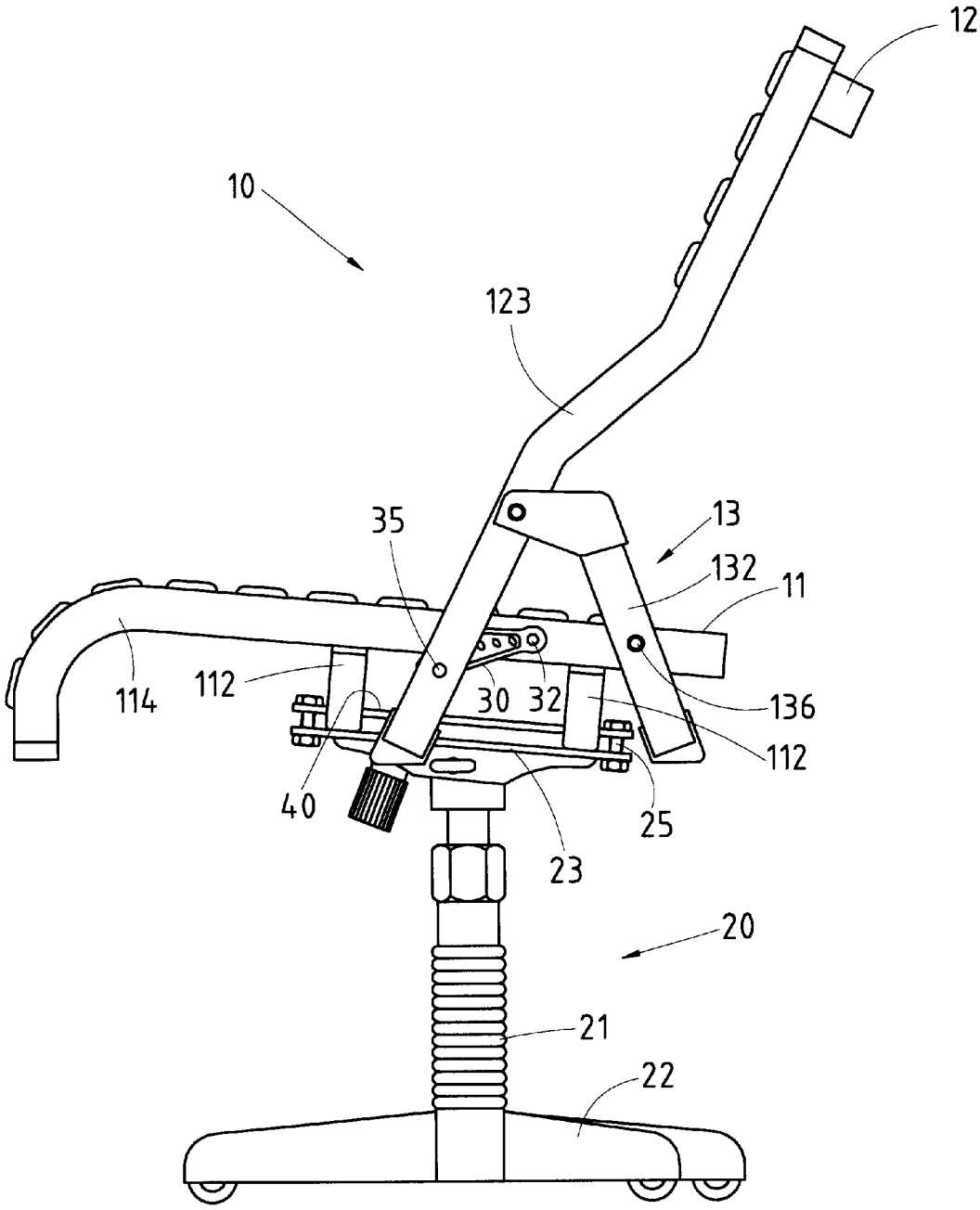
FIG. 3 shows a side schematic view of the preferred embodiment of the present invention as shown in FIG. 1.
Figure 4:
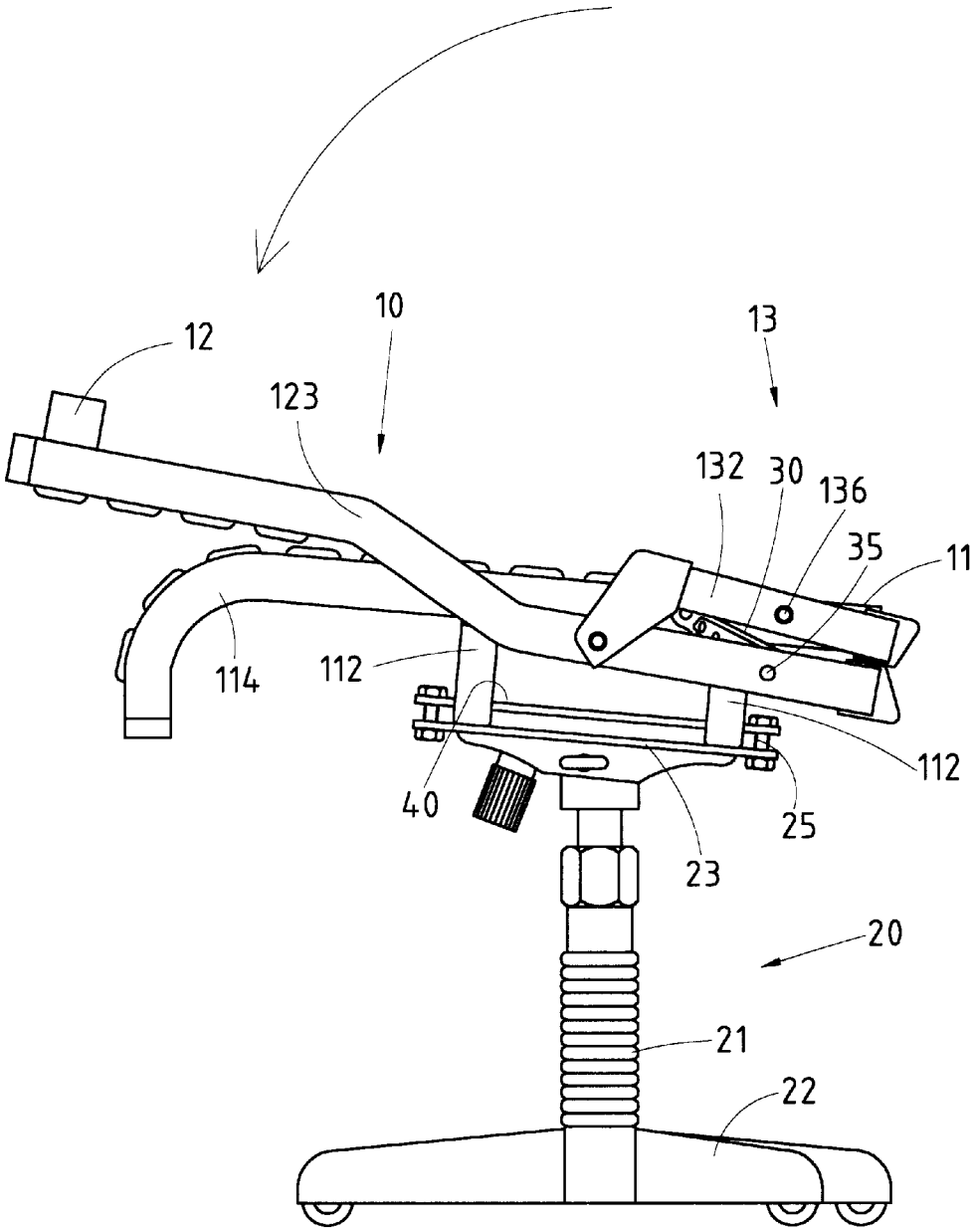
FIG. 4 shows a side schematic view of the folding of the preferred embodiment of the present invention as shown in FIG. 1.

As shown in FIGS. 1–4, a dual-purpose chair embodied in the present invention comprises a seat structure 10, and a base structure 20.

The seat structure 10 is formed of a seat 11, a backrest 12, and a backrest support frame 13. The seat 11 is provided in the underside with two inverted U-shaped support rods 112 by which the seat structure 10 is detachably fastened with the base structure 20. The backrest 12 has two long side rods 123 opposite to each other. The two long side rods 123 are connected with each other at the top end thereof and are provided at the bottom end thereof with a support portion 125. The backrest support frame 13 is of a U-shaped construction and is provided with two arms 132, which are respectively pivoted at the free end with the two side rods 123 of the backrest 12, and at the midsegment with two longitudinal side rods 114 of the seat 11. The backrest support frame 13 has a crown portion 134, which is located under one longitudinal end of the seat 11.

The base structure 20 is formed of an upright rod 21, a plurality of caster seat arms 22 extending radially from the bottom end of the upright rod 21, a support plate 23 mounted on the top end of the upright rod 21 and provided with a plurality of fastening holes 24, and a cover plate 40 corresponding in shape and size to the support plate 23. the cover plate 40 is provided with a plurality of fastening holes and is fastened to the support plate 23 by a plurality of fastening bolts 25 which are received in the fastening holes of the support plate 23 and the cover plate 40. The cover plate 40 is intended to conceal the support plate 23 and to fasten the base structure 20 to the seat structure 10 in conjunction with the support plate 23. In other words, the base structure 20 is fastened with the two support rods 112 of the seat 11 of the seat structure 10 by the fastening bolts 25.

Figure 5:
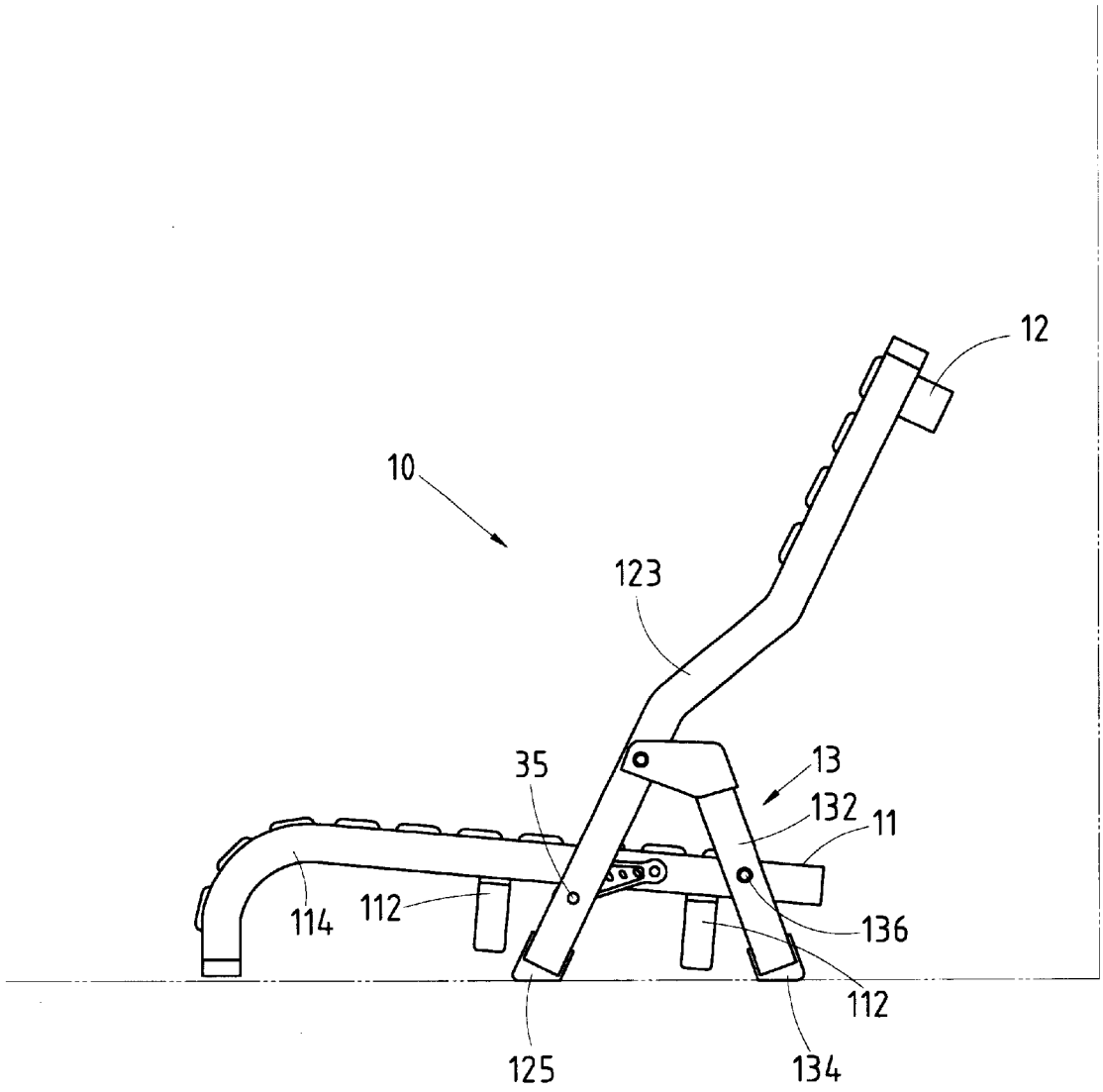
FIG. 5 shows a side schematic view of the preferred embodiment of the present invention in use as a deck chair.

As shown in FIGS. 1–4, the dual-purpose chair of the present invention serves as an office chair. The seat structure 10 and the base structure 20 of the chair of the present invention can be separated from each other by unfastening the fastening bolts 25 of the support structure 20. The seat structure 10 is then used as a deck chair such that the two support portions 125 of the two side rods 123 of the backrest 12 are rested on a floor surface, and that the crown portion 134 of the backrest support frame 13 is also rested on the floor surface, as illustrated in FIG. 5.

The two side rods 123 of the backrest 12 of the seat structure 10 are pivotally fastened with the two longitudinal side rods 114 of the seat 11 by a pivoting block 30 which is provided at one end with a first pivoting hole 31, at other end with a second pivoting hole 34, and a receiving slot 33. The side rods 123 of the backrest 12 are pivoted with the side rods 114 of the seat 11 by the pivoting block 30 such that the side rod 114 of the seat 11 is received in the receiving slot 33 of the pivoting block 30, and that a first pivot 32 is fastened with the side rod 114 of the seat 11 via the first pivoting hole 31, and that the other end of the pivoting block 30 is fastened with the side rod 123 of the backrest 12 by a second pivot 35 via the second pivoting hole 34. As a result, the backrest 12 can be swiveled in relation to the seat 11 such that the backrest 12 can be turned on a pivoting point 136 of the backrest support frame 13 toward the front end of the seat 11, as indicated by an arrow in FIG. 4.

Figure 6:
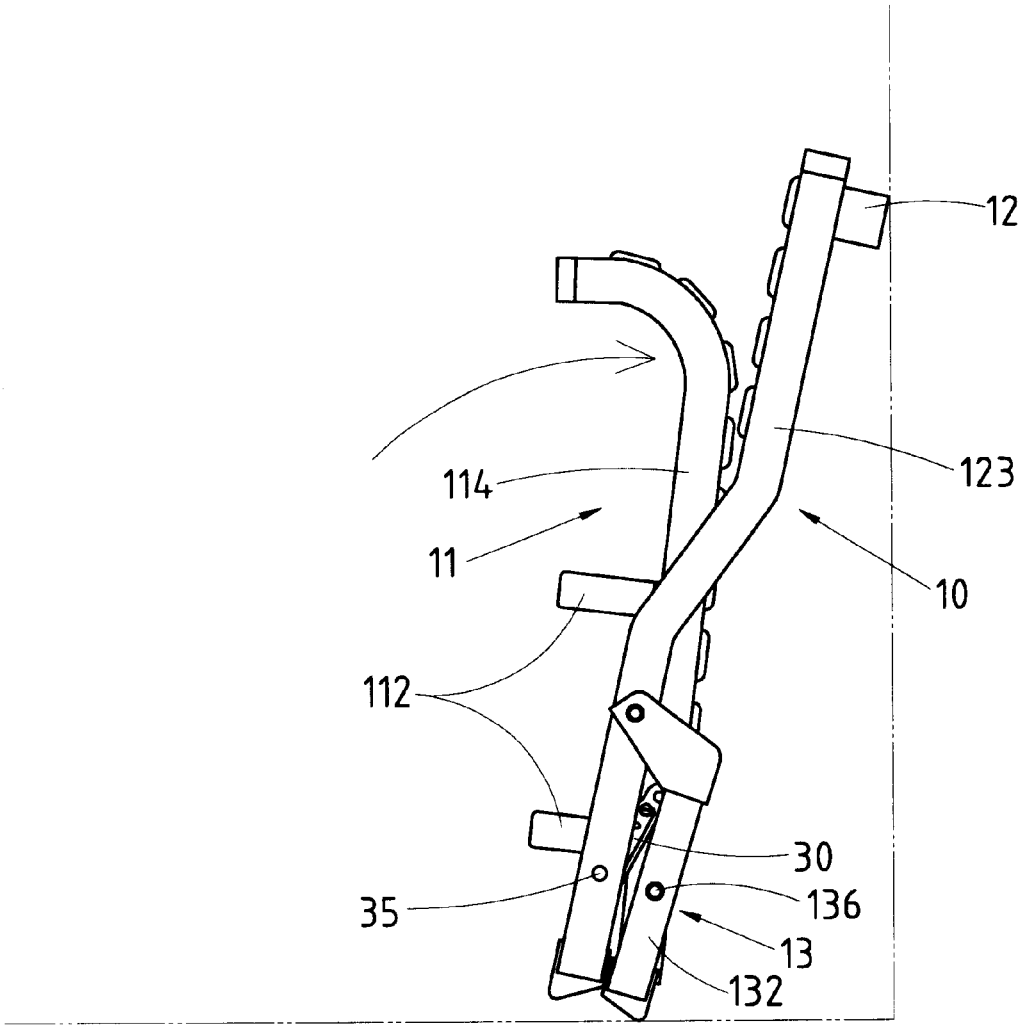
FIG. 6 shows a side sectional view of the folding of the preferred embodiment of the present invention as shown in FIG. 5.

In light of the pivoting blocks 30, the seat structure 10 of the present invention can be folded such that the backrest 12 and the seat 11 are joined together, as shown in FIG. 6.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A dual-purpose chair comprising:

a seat structure formed of a seat and a backrest and a backrest support frame, said seat having a pair of side rods affixed on opposite sides of said seat, said seat having a pair of support rods on an underside thereof, said backrest having a pair of side rods affixed on opposite sides thereof, each of said pair of side rods of said backrest having a support portion at a bottom end thereof, said backrest support frame having a pair of arms at opposite sides thereof, said pair of arms of said backrest support frame being connected together by a crown portion, said pair of arms of said backrest support frame being respectively pivotally connected at a free end thereof to said pair of side rods of said backrest, said pair of arms of said backrest support frame being respectively pivotally connected at a mid-segment thereof with said pair of side rods of said seat, said crown portion being positioned under one end of said seat; and a base structure having an upright rod and a plurality of caster seat arms extending radially outwardly from a bottom end of said upright rod, said base structure having a support plate mounted on a top end of said upright rod, said support plate having a plurality of fastening holes formed therein, said base structure being detachably fastened to said seat structure by a plurality of fastening bolts, said pair of support rods of said seat being fastened to said support plate of said base structure by said plurality of fastening bolts, said plurality of fastening bolts being respectively received in said plurality of fastening holes.

2. The dual-purpose chair of claim 1 wherein each of said pair of side rods of said backrest is pivotally fastened respectively through a pivoting block to each of said pair of side rods of said seat, said pivoting block having a plurality of pivot holes.

3. The dual-purpose chair of claim 2, said pivoting block having one of said plurality of pivot holes at one end thereof, said pivoting block having another of said plurality of pivot holes at an opposite end thereof, said pivoting block having a receiving slot formed therein, one of said pair of side rods of said seat being affixed by a pivot pin to said pivot block through the hole at said one end thereof, one of said pair of side rods of said backrest affixed by another pivot pin to said pivot block through the hole at said opposite end thereof.

* * * * *